US007245861B2

(12) United States Patent
Koike et al.

(10) Patent No.: US 7,245,861 B2
(45) Date of Patent: Jul. 17, 2007

(54) DEVELOPING DEVICE, IMAGE FORMING APPARATUS AND PROCESS CARTRIDGE INCLUDING THE DEVELOPING DEVICE, AND DEVELOPING METHOD

(75) Inventors: Takayuki Koike, Kanagawa (JP); Hajime Oyama, Chiba (JP); Hiromitsu Takagaki, Kanagawa (JP); Nobutaka Takeuchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 273 days.

(21) Appl. No.: 10/875,316

(22) Filed: Jun. 25, 2004

(65) Prior Publication Data

US 2004/0265015 A1 Dec. 30, 2004

(30) Foreign Application Priority Data

Jun. 26, 2003 (JP) ..... 2003-183334
Mar. 17, 2004 (JP) ..... 2004-075937

(51) Int. Cl.
*G03G 15/08* (2006.01)
*G03G 15/09* (2006.01)

(52) U.S. Cl. ..... 399/274; 399/284

(58) Field of Classification Search ..... 399/274, 399/276, 277, 284
See application file for complete search history.

(56) References Cited

U.S. PATENT DOCUMENTS 4,165,393 A 8/1979 Suzuki et al.
4,171,899 A 10/1979 Yanagawa et al.
4,193,679 A 3/1980 Mochizuki et al.
4,194,830 A 3/1980 Ohnuma et al.
4,201,465 A 5/1980 Oyama et al.
4,286,543 A 9/1981 Ohnuma et al.
4,350,749 A 9/1982 Ohnuma et al.
4,382,420 A 5/1983 Ohnuma et al.
4,406,536 A 9/1983 Suzuki et al.
4,760,427 A 7/1988 Oyama et al.
4,792,825 A 12/1988 Saito et al.
4,821,075 A 4/1989 Saito et al.
4,989,043 A 1/1991 Suzuki et al.
5,083,160 A 1/1992 Suzuki et al.
5,182,600 A 1/1993 Hasegawa et al.
5,198,861 A 3/1993 Hasegawa et al.

(Continued)

FOREIGN PATENT DOCUMENTS

JP 8-278695 10/1996

(Continued)

OTHER PUBLICATIONS

U.S. Appl. No. 07/289,253, filed Dec. 23, 1988.

(Continued)

*Primary Examiner*—William J. Royer
(74) *Attorney, Agent, or Firm*—Oblon, Spivak, McClelland, Maier & Neustadt, P.C.

(57) ABSTRACT

A developing device includes a developer carrier that carries a developer and a developer restricting member that restricts a layer thickness of the developer on the developer carrier. The developer carrier carries the developer in such a manner that a thickness Tup of a layer of the developer when the layer passes through the developer restricting member and a gap Gd between the developer restricting member and the developer carrier satisfy an inequality 7<Tup/Gd<20.

18 Claims, 8 Drawing Sheets

U.S. PATENT DOCUMENTS

| | | | | |
|---|---|---|---|---|
| 5,450,177 | A | 9/1995 | Oyama | |
| 5,467,175 | A | 11/1995 | Takagaki et al. | |
| 5,493,382 | A | 2/1996 | Takagaki et al. | |
| 5,502,552 | A | 3/1996 | Iwata et al. | |
| 5,604,575 | A | 2/1997 | Takagaki et al. | |
| 5,655,200 | A | 8/1997 | Oyama | |
| 5,659,860 | A | 8/1997 | Sasaki et al. | |
| 5,737,680 | A | 4/1998 | Takagaki et al. | |
| 5,754,929 | A * | 5/1998 | Nonomura et al. | 399/274 |
| 5,758,241 | A | 5/1998 | Oyama et al. | |
| 5,771,426 | A | 6/1998 | Oka et al. | |
| 5,771,429 | A | 6/1998 | Oyama et al. | |
| 5,805,965 | A | 9/1998 | Tsuda et al. | |
| 5,822,664 | A | 10/1998 | Oka et al. | |
| 5,864,733 | A | 1/1999 | Mae et al. | |
| 5,937,228 | A | 8/1999 | Shoji et al. | |
| 5,953,568 | A | 9/1999 | Fujishiro et al. | |
| 6,366,751 | B1 | 4/2002 | Shakuto et al. | |
| 6,442,364 | B2 | 8/2002 | Kai et al. | |
| 6,463,244 | B2 | 10/2002 | Aoki et al. | |
| 6,505,014 | B2 | 1/2003 | Aoki et al. | |
| 6,522,855 | B1 * | 2/2003 | Terai et al. | 399/274 |
| 6,526,248 | B1 | 2/2003 | Aoki et al. | |
| 6,597,885 | B2 | 7/2003 | Kai et al. | |
| 6,611,672 | B2 | 8/2003 | Aoki et al. | |
| 6,625,409 | B2 | 9/2003 | Shakuto et al. | |
| 6,654,579 | B2 | 11/2003 | Shakuto et al. | |
| 6,658,227 | B2 | 12/2003 | Oyama et al. | |
| 6,665,511 | B2 | 12/2003 | Takeuchi et al. | |
| 6,721,516 | B2 | 4/2004 | Aoki et al. | |
| 6,757,509 | B2 | 6/2004 | Shoji et al. | |
| 6,778,805 | B2 | 8/2004 | Kai et al. | |
| 2004/0265015 | A1 | 12/2004 | Koike et al. | |

FOREIGN PATENT DOCUMENTS

| | | |
|---|---|---|
| JP | 10-333431 | 12/1998 |
| JP | 2002-258616 | 9/2002 |

OTHER PUBLICATIONS

U.S. Appl. No. 09/708,659, filed Nov. 9, 2000, Yasutomi et al.
U.S. Appl. No. 09/864,335, filed May 25, 2001, Sugimoto et al.
U.S. Appl. No. 10/028,767, filed Dec. 28, 2001.
U.S. Appl. No. 10/028,769, filed Dec. 28, 2001.
U.S. Appl. No. 10/026,743, filed Dec. 27, 2001, Yano et al.
U.S. Appl. No. 10/158,069, filed May 31, 2002, Matsuda et al.
U.S. Appl. No. 10/391,575, filed Mar. 20, 2003, Suzuki et al.
U.S. Appl. No. 10/438,938, filed May 16, 2003, Oyama et al.
U.S. Appl. No. 10/638,432, filed Aug. 12, 2003, Kadota et al.
U.S. Appl. No. 10/647,346, filed Aug. 26, 2003, Suzuki et al.
U.S. Appl. No. 10/875,316, filed Jun. 25, 2004, Takayuki et al.
U.S. Appl. No. 11/175,282, filed Jul. 7, 2005, Oyama et al.
U.S. Appl. No. 11/210,826, filed Aug. 25, 2005, Matsuura et al.
U.S. Appl. No. 11/349,244, filed Feb. 8, 2006, Takeuchi et al.

* cited by examiner

DEVELOPING DEVICE, IMAGE FORMING APPARATUS AND PROCESS CARTRIDGE INCLUDING THE DEVELOPING DEVICE, AND DEVELOPING METHOD

CROSS-REFERENCE TO RELATED APPLICATIONS

The present document incorporates by reference the entire contents of Japanese priority document, 2003-183334 filed in Japan on Jun. 26, 2003 and 2004-075937 filed in Japan on Mar. 17, 2004.

BACKGROUND OF THE INVENTION

1) Field of the Invention

The present invention relates to a technology for developing a latent image carried on an image carrier with a two-component developer.

2) Description of the Related Art

A developing device is widely used in an image forming apparatus for developing an electrostatic latent image using a two-component developer (hereinafter, "developer"), i.e., a developer that contains a toner and a magnetic carrier. The developer is accommodated in a developer accommodating unit and is subjected to triboelectric charging. A photosensitive body serves as an image carrier for carrying an electrostatic latent image. The developer is carried onto a surface of a developer carrier, which has a non-magnetic sleeve and a magnetic field generating unit inside, so that the developer is conveyed to a developing region opposed to the photosensitive body. In the developing region, an electric field corresponding to an image is formed between the electrostatic latent image on the photosensitive body and the sleeve, and toner in the developer on the sleeve is attached to the photosensitive body by the electric field so that development is performed to form an image.

To perform an appropriate developing, an appropriate amount of the developer is conveyed to the developing region. A doctor blade that is provided opposed to the sleeve, with a predetermined clearance, as a means that allows only a desired amount of the developer to be carried on the sleeve and conveyed to the developing region. Precisely, if there is extra developer on the sleeve, the doctor blade scraps it. However, when the doctor blade scraps the developer, it exerts a mechanical stress on both the developers, i.e., the developer that is scrapped and that is allowed to pass. If the developer receives the mechanical stress repeatedly, the quality of the developer deteriorates. Precisely, crushing of toner and carrier, burring/separating of additives into/from toner, or toner component spent to carrier occurs due to the mechanical stress. Such a developer is difficult to electrically charge uniformly so that drawbacks such as degradation of graininess over time, a background fogging, and toner scattering occur.

In particular, when toner in which wax is dispersed for ensuring a fusing releaseability corresponding to oilless fusing is used as the toner, the wax component with the same polarity as the toner oozes on the toner surface due to heat generated by the mechanical stress so that the carrier surface is coated with a film of the wax. If there is a wax film on the carrier, the carrier can not be charged properly so that the amount of charged toner becomes less than desired. This causes problems such as toner scattering or background fogging. Various proposals have been made to overcome this problem.

Japanese Patent Application Laid-Open No. H8-278695, for example, discloses a developing device in which a diametrical magnetic flux density of a magnetic pole inside a developer carrier at a position opposed to a developer restricting member is set in the range of 5 millitesla to 35 millitesla. Because the diametrical magnetic flux density is less, lesser mechanical stress is exerted on the developer at the developer restricting member.

Japanese Patent Application Laid-Open No. H10-333431 discloses a developing device in which a plurality of developer restricting members are arranged along a rotational direction of a developer carrier, the developer restricting member positioned at the most downstream side is formed as a magnetic member, and a center portion of a trimming magnetic pole of fixed magnets positioned inside the developer carrier before a developing region is arranged between the developer restricting members of the most downstream side and the most upstream side. In this developing device, the developer on the developer carrier sequentially forms layers while passing through the developer restricting members. Since a magnetic force of the trimming magnetic pole is arranged so as to act mainly between the magnetic member of the most downstream developing restricting member and itself, a magnetically restricting force acts on a gap portion of the most downstream developer restricting member so that the developer passes through the gap portion in a spiked state. Therefore, even if the most downstream developer restricting member has a board gap, it is made possible to form a thin layer, and the mechanical stress can be reduced at the gap portion.

In the developing device of Japanese Patent Application Laid-Open No. H10-333431, however, there is no description of stresses on the developer from the developer restricting members except the most downstream developer restricting member. Therefore, the degree or magnitude of the mechanical stress that can be reduced as the whole developer restricting unit is unclear. In addition, an adverse effect such that the number of parts is increased, that results in complication of the apparatus, and a manufacturing cost is increased is found in the developing device.

Japanese Patent Application No. 2002-258616 discloses a developing device in which excessive developer held by a developer carrier is caused to drop from a rotational center height of a developing roller due to its own weight to form a thinner developer layer by devising a magnetic constitution of the developer carrier, and a doctor blade does not perform restriction. In this developing device, since it is unnecessary to provide a doctor blade, mechanical stress on the developer can be reduced.

In order to perform development with a high quality faithful to an electrostatic latent image, toner in conveyed developer is charged sufficiently the developer is conveyed to a developing region. The toner in the developer is charged by contacting with carrier in a developer accommodating unit and it is further charged by contacting with the carrier under mechanical stress from a doctor blade to be conveyed to the developing region. For this reason, when mechanical stress due to the doctor blade is merely reduced like the apparatuses in Japanese Patent Application Laid-Open Nos. H8-278695 and H10-333431, it becomes impossible to charge toner in the developer sufficiently. The toner that is not charged sufficiently becomes easy to separate from the developer, which causes such a drawback as toner scattering or scumming. In this manner, two functions of achieving a long life of developer by reducing stress on the developer and ensuring charging performance of the toner are required for the doctor blade.

In the developing device that is not provided with a doctor blade, disclosed in Japanese Patent Application No. 2002-258616, a charging member that charges the developer and an averaging member that averages the developer reaching the developing region are required as separate members, that results in increase in cost due to increase of the number of parts.

SUMMARY OF THE INVENTION

It is an object of the present invention to solve at least the problems in the conventional technology.

A developing device according to an aspect of the present invention includes a developer accommodating unit that accommodates two-component developer containing toner and magnetic carrier; a developer carrier that includes a rotatable non-magnetic sleeve that includes a plurality of fixed magnetic field generating units therein and causes the magnetic field generating units to carry two-component developer inside the developer accommodating unit on a surface thereof to convey the same to a developing region opposed to an image carrier; and a developer restricting member that restricts a layer thickness of developer on the developer carrier, wherein a thickness Tup of a layer of the developer when the layer passes through the developer restricting member and a gap Gd between the developer restricting member and the developer carrier satisfy an inequality $7<Tup/Gd<20$.

A color image forming apparatus according to another aspect of the present invention includes an image carrier that carries an electrostatic latent image and a developing device for each of a plurality of colors, wherein the developing device is the developing device according to the present invention.

A process cartridge according to still another aspect of the present invention supports an image carrier that carries a latent image and a developing device that supplies toner to the latent image on the image carrier in an integral manner to develop the latent image, and is attachable to/detachable from an image forming apparatus main body, wherein the developing device is the developing device according to the present invention.

A developing method according to still another aspect of the present invention is a method of developing an image using a developing device that includes a developer accommodating unit that accommodates two-component developer containing toner and magnetic carrier; a developer carrier that includes a rotatable non-magnetic sleeve that includes a plurality of fixed magnetic field generating units therein and causes the magnetic field generating units to carry two-component developer inside the developer accommodating unit on a surface thereof to convey the same to a developing region opposed to an image carrier; and a developer restricting member that restricts a layer thickness of developer on the developer carrier, comprising conducting developing under a condition that a thickness Tup of a layer of the developer when the layer passes through the developer restricting member and a gap Gd between the developer restricting member and the developer carrier satisfy an inequality $7<Tup/Gd<20$.

The other objects, features, and advantages of the present invention are specifically set forth in or will become apparent from the following detailed description of the invention when read in conjunction with the accompanying drawings.

DETAILED DESCRIPTION

Exemplary embodiments of an electrophotographic type printer (hereinafter, "printer") will be explained below as an image forming apparatus to which the present invention is applied.

Figure 1:
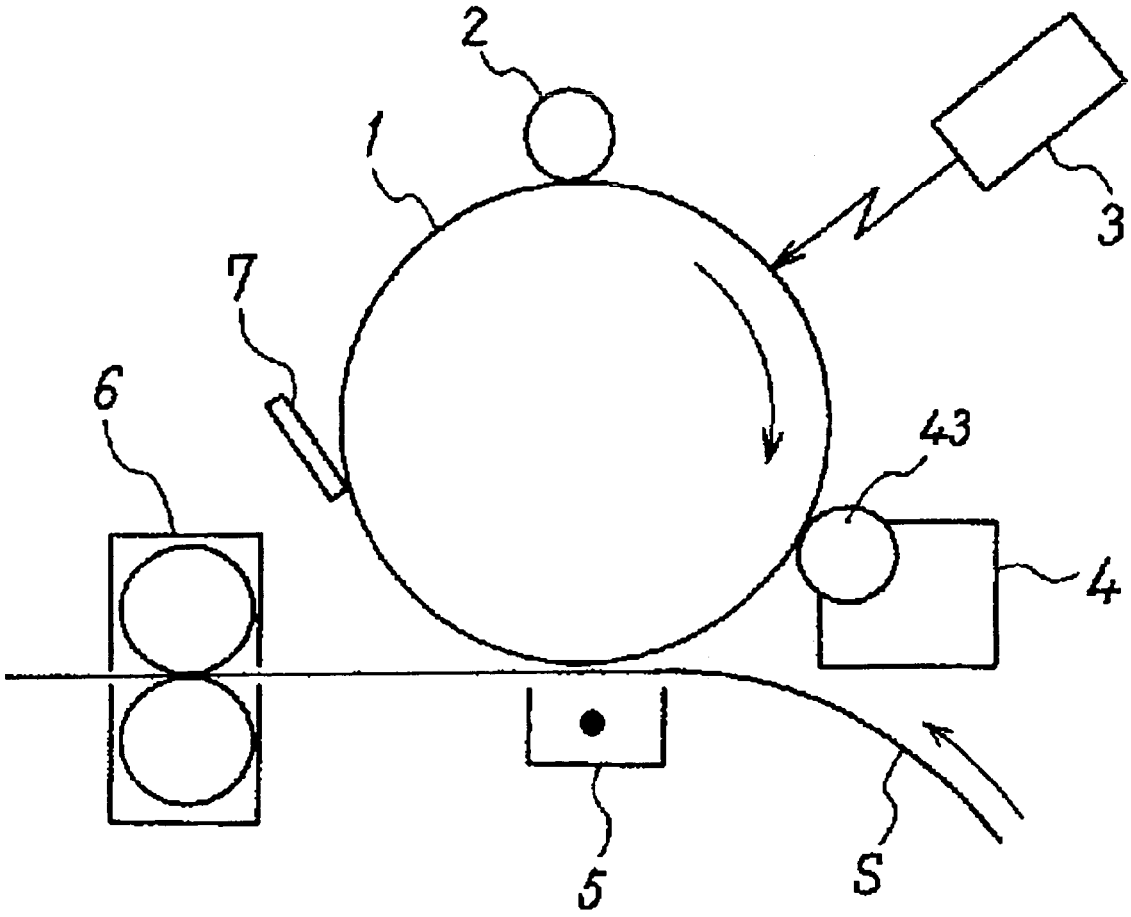
FIG. 1 is a side view of main sections of an image forming apparatus according to an embodiment of the present invention.

FIG. 1 is a side view of main sections of a printer according to the embodiment. The printer includes a charging device 2, an optical writing device 3, a developing device 4, a transferring device 5, a drum cleaning device 7, a charge removing device (not shown), and the like arranged around a drum-shaped photosensitive body 1 serving as an image carrier. The printer is also provided with a fixing unit 6 arranged on a left side of the transferring device 5 in FIG. 1.

The photosensitive body 1 is rotationally driven by a driving unit (not shown) in a clockwise direction in FIG. 1. The photosensitive body 1 has an organic photosensitive layer formed on a surface of a raw pipe made of aluminum or the like, the photosensitive layer including a charge generating layer and a charge transporting layer, and the photosensitive body 1 is uniformly charged to positive or negative polarity according to its rotation by the charging device 2. The potential of an exposed portion is reduced by scanning of a laser beam L emitted from the optical writing device 3 establishing optical scanning information based on image information sent from a personal computer (not shown) or the like. Thereby, an electrostatic latent image with a potential smaller than that in a background portion around the exposed portion is carried. When the electrostatic latent image passes through a developing position that is a position opposed to the developing device 4 according to rotation of the photosensitive body 1, it is rubbed by developer containing toner and magnetic carrier carried by a developing sleeve 43 of the developing device 4 in a sliding manner. The electrostatic latent image is electrostatically attached with, for example, toner with negative polarity contained in the developer to be developed to a toner image.

A transferring position where the photosensitive body 1 and the transferring device 5 are opposed to each other is formed at a downstream side of the developing position in a rotational direction of the photosensitive body 1. When the toner image developed on the photosensitive body 1 enters in the transferring position as the photosensitive body 1 rotates, it is superimposed to a sheet-like transfer medium S conveyed by a paper feeding unit (not shown) in a timed manner with the paper conveyance. An electrostatic transfer is performed on the transfer medium S by influence of a transferring electric field formed between the exposed portion on the photosensitive body 1 and the transferring device 5. The transfer medium S electrostatically attached to the photosensitive body 1 at the time of transfer is separated from the photosensitive body 1 due to action such as paper weight, paper stiffhess, or a member (not shown) for paper separation and conveyance. The recording sheet S with the toner image electrostatically transferred in this manner is fed from the transferring position to the fixing unit 6.

The fixing unit 6 forms a fusing nip by bringing a heating roller having a heat source (not shown) therein and a pressure roller pressed against the heating roller into contact with each other. These rollers are rotationally driven such that their respective surfaces are moved in the same direction at their contacting portions with each other. The recording sheet S fed to the fixing unit 6 with such a configuration is nipped in the fusing nip to be conveyed in a roller surface moving direction. At this time, the toner image is fused due to nipping pressure and heating. The transfer medium S after fusion is discharged outside the apparatus via a discharging unit (not shown).

The drum cleaning device 7 cleans the residual toner on the surface of the photosensitive body 1. Then, the residual charges are eliminated by a charge eliminating device (not shown), so as to prepare for the next image forming step.

Figure 7:
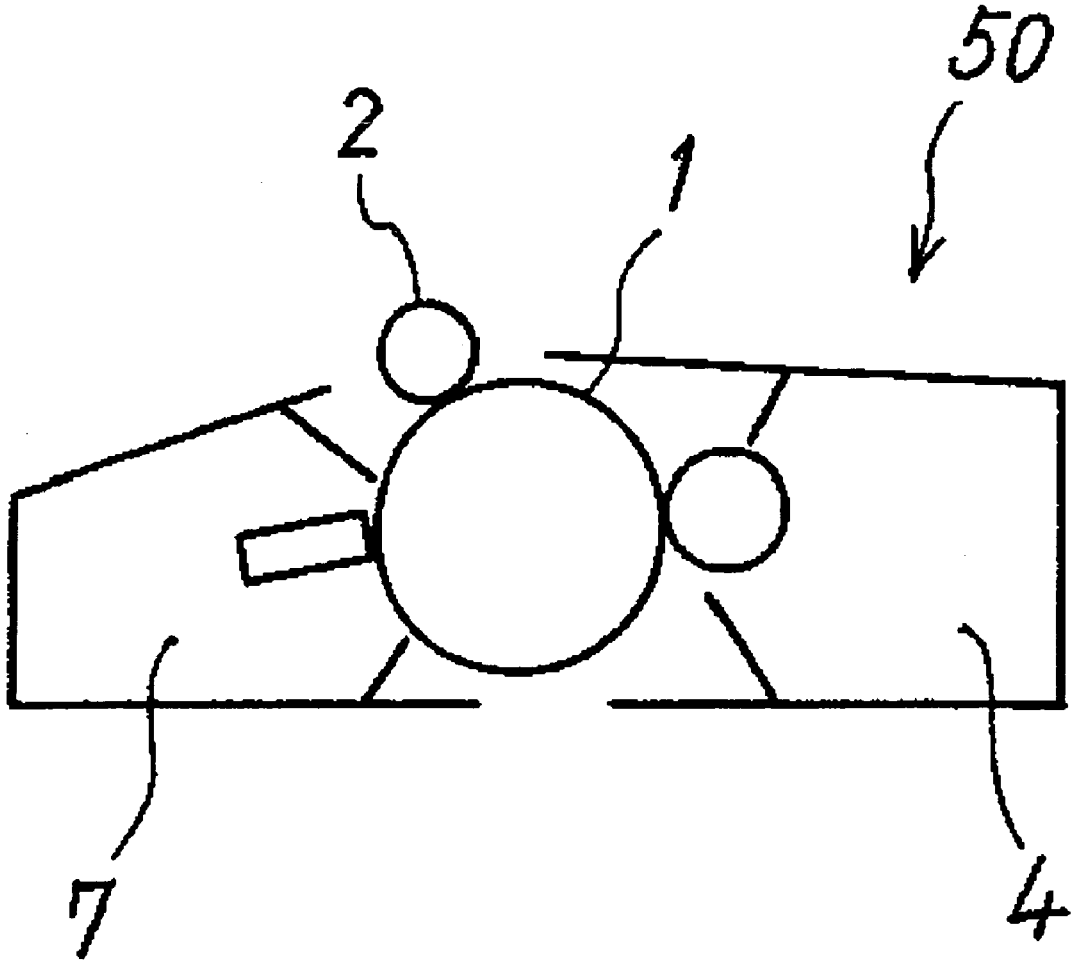
FIG. 7 is a side view of a process cartridge according to the embodiment.

FIG. 1 illustrates an example of a device of a type where a biasing member such as a charging roller to which a charging bias is applied is brought in contact with the photosensitive body 1, but a device of a non-contacting type such as a triboelectric charger may be used as the charging device 2. As an example, the optical writing device 3 forming an electrostatic latent image by irradiation of a laser beam L is provided, but a device that performs optical writing by a light emitting diode (LED) light from an LED array may be used. Instead of the optical writing, an electrostatic latent image may be formed by ion spraying or the like. A non-contacting type device such as a transferring charger is explained as the transferring device 5, but a device of a roller contacting type where a transferring roller applied with a transferring bias is brought in contact with the photosensitive body 1 or a device of a belt contacting type where a belt is brought in contact with the same may be used. A device of a scraping type where the residual toner is scraped by a cleaning blade is explained as the drum cleaning device 7, but a device of an electrostatic recovering system where a brush or a roller applied with a cleaning bias is brought in contact with the residual toner may be used. The example where the drum-like photosensitive body 1 is provided as the latent image carrier is explained, but a belt-like photosensitive body may be used. The example of the printer where the photosensitive body 1 and the peripheral devices are provided individually is explained, but a process cartridge 50 where the photosensitive body 1 and the peripheral devices are accommodated in one or common casing may be used, as shown in FIG. 7. For example, the photosensitive body 1, the charging device 2, the developing device 4, and the drum cleaning device 7 are configured as one process cartridge 50 and the process cartridge 50 is made attachable/detachable to a printer main body.

Figure 2:
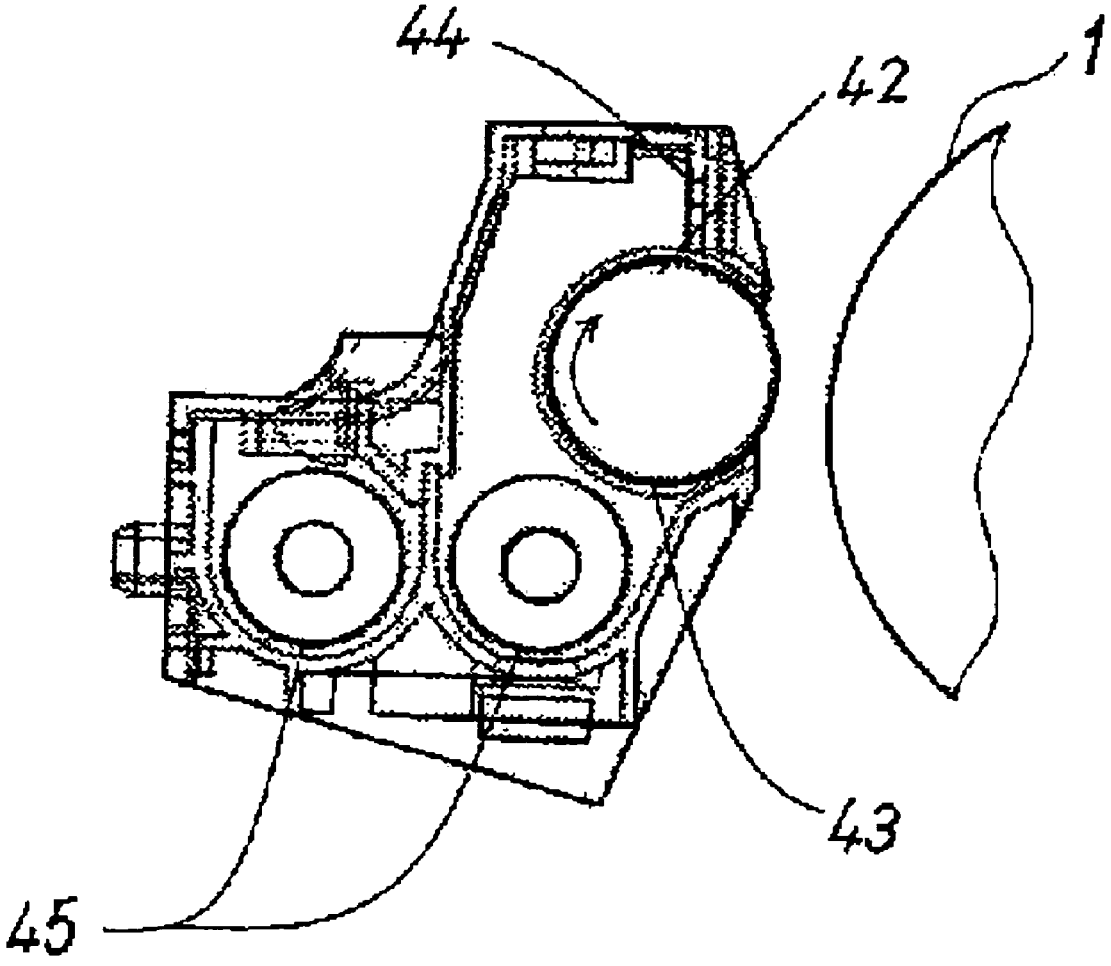
FIG. 2 is an enlarged side view of main sections of a developing device according to the embodiment.

FIG. 2 is an enlarged side view of main sections of the developing device 4. The developing device 4 includes a developer accommodating chamber that accommodates developer including toner and carrier, screws 45 that are rotationally driven for stirring and conveying the developer are provided in the chamber, and a developing sleeve 43 is arranged so as to be exposed partially from a portion of the chamber opposed to the photosensitive body 1. A partition wall is provided in a developer conveying path, and toner is supplied from a toner supply port (not shown) of the conveying path that is positioned at a farther side from the developing sleeve 43. For preventing toner from being supplied to the developing sleeve 43 in an unmixed state of the toner with carrier just after being supplied, after the toner is sufficiently mixed with the carrier while being conveyed in a longitudinal direction of the conveying path, the toner sufficiently mixed with the carrier is delivered to another conveying path from an opening portion (not shown) and it is drawn up to the developing sleeve 43. The developing sleeve 43 is made of aluminum or any non-magnetic stainless steel, it is a non-magnetic cylindrical member with appropriate irregularities obtained by sand blast or groove formation on its surface and it is rotationally driven with a proper linear velocity by a rotational driving device (not shown). The developing sleeve 43 has a magnet roller 42 fixedly arranged with a magnet member with a plurality of magnetic poles inside thereof, and it can carry the developer to convey the same according to rotation thereof. The magnet roller 42 has the magnetic poles and the magnetic poles have their respective functions. Poles required basically include a developing pole that spikes developer in the developing region, a drawing pole that draws developer up on the developing sleeve 43, and a conveying pole that conveys developer, and they may be configured of five to ten poles.

A doctor blade 44 that restricts the amount of developer on the developing sleeve 43 is provided, as a developer restricting member, at an upstream side of the developing region in a rotational direction of the developing sleeve 43. After the amount of developer on the developing sleeve 43 is restricted to a desired amount by the doctor blade 44, a magnetic brush is formed by the magnet roller 42 inside the developing sleeve 43, and an electrostatic latent image on the photosensitive body 1 is brought in contact with the magnetic brush in the developing region. The developing sleeve 43 is connected with a power source (not shown) that applies a developing bias voltage for forming a developing electric field to the developing sleeve 43 in the developing region, and it is made possible to form an image by attaching charged toner in the developer on the developing sleeve 43 to the electrostatic latent image on the photosensitive body 1.

A linear velocity of the developing sleeve 43 is preferably in the range of 1.1 to 3.0 times a linear velocity of the photosensitive body 1, and more preferably in the range of 1.5 to 2.5 times. When the linear velocity is below 1.1 times, image density degrades, but if the linear velocity is above 3.0 times, toner scattering or image disturbance occurs. The optimal value of a developing gap Gp between the photosensitive body 1 and the developing sleeve 43 varies according to a particle diameter of carrier to be used or a drawing amount ρ, but it is preferable that the developing gap Gp is in a small range of 0.2 millimeter (mm) to 0.5 mm in order to give a margin to the developing capability.

As the toner constituting the developer, conventionally used toner may be used. Toner which is obtained by mixing binding resin, wax component, coloring agent, and charging control agent, if necessary, using a mixer or the like, kneading the mixture in such a kneading machine as a heat roll, or an extruder, then cooling and solidifying the kneaded material, crushing the material in a crusher such as a jet mill, and classifying particles of the crushed materials, can be used. In view of image quality or manufacturing cost, it is preferable that toner obtained by a polymerization method that is easy to manufacture toner with a small particle diameter, a spherical shape, and a particle diameter distribution in a small width range is used. It is preferable that a volume average particle diameter of toner is in the range of 4 micrometers (μm) to 8 μm. It is generally said that the smaller the particle diameter of toner becomes, the more advantageous for obtaining an image with a high resolution and a high quality but the more disadvantageous for a transfer performance and cleaning performance. As the particle diameter of the toner becomes smaller, the toner becomes easy to melt-adhere to a carrier surface, which results in promotion in lowering of charging ability of the carrier. When the toner particle diameter exceeds this range, it becomes difficult to obtain an image with a high resolution. Same can be said to the ratio of Dv/Dn.

As an additive for assisting fluidity, developing property, and chargeability of toner, inorganic fine particles such as silica, alumina, or titanium oxide can preferably be used. A primary particle diameter of the inorganic fine particles is preferably in the range of 2 μm to 5 μm, and more preferably in the range of 5 μm to 500 μm. It is preferable that a specific area obtained by BET process is in the range of 20 $m^2/g$ to 500 $m^2/g$. The ratio of use of the inorganic fine particles is preferably in the range of 0.01 weight % to 5 weight %, and in particular more preferably in the range of 0.5 weight % to 3.0 weight %.

The content ratio of carrier and toner in a developer is preferably in the range of 1 to 10 weight parts of the toner to 100 weight parts of the carrier. As a magnetic carrier, a conventionally known carrier with a particle diameter of about 20 μm to 200 μm such as iron powder, ferrite powder, magnetite powder, or magnetic resin carrier can be used. As a coating material, amino resin, polyvinyl and polyvinylidene resin, polystyrene resin, silicone resin, and the like can be used. As a carrier particle diameter, carrier having a diameter of 35 μm is used in the following embodiment, but the diameter is preferably in the range of 20 μm to 100 μm, and more preferably in the range of 30 μm to 60 μm. The smaller the particle diameter of the carrier is, the higher resolution can be obtained like the case of the toner. However, when the particle diameter of the carrier becomes excessively small, carrier scattering or carrier adhesion is caused, that is undesirable.

The life of the developing device 4 mainly depends on deterioration of the developer, and in particular, it is influenced by lowering of the charging ability of carrier that continues to be used repeatedly within the developing device 4. The lowering of the charging ability of the carrier is mainly caused due to local adhesion of toner component to carrier. In particular, wax is dispersed in oilless toner for fusion in order to ensure fusing releaseability. When stress is applied to the developer, the wax component is oozed on the toner surface due to heat generated by the stress and the carrier surface is filmed by the wax component. As a result, a phenomenon occurs that the wax with the same polarity as the toner polarity is adhered to the carrier so that the toner can not be charged even when the carrier is brought in contact with the toner. When the charging ability of the carrier is lowered in this manner, the charged amount in the toner is reduced as a whole, so that various problems including toner scattering, background fogging, and the like are caused.

Figure 4:
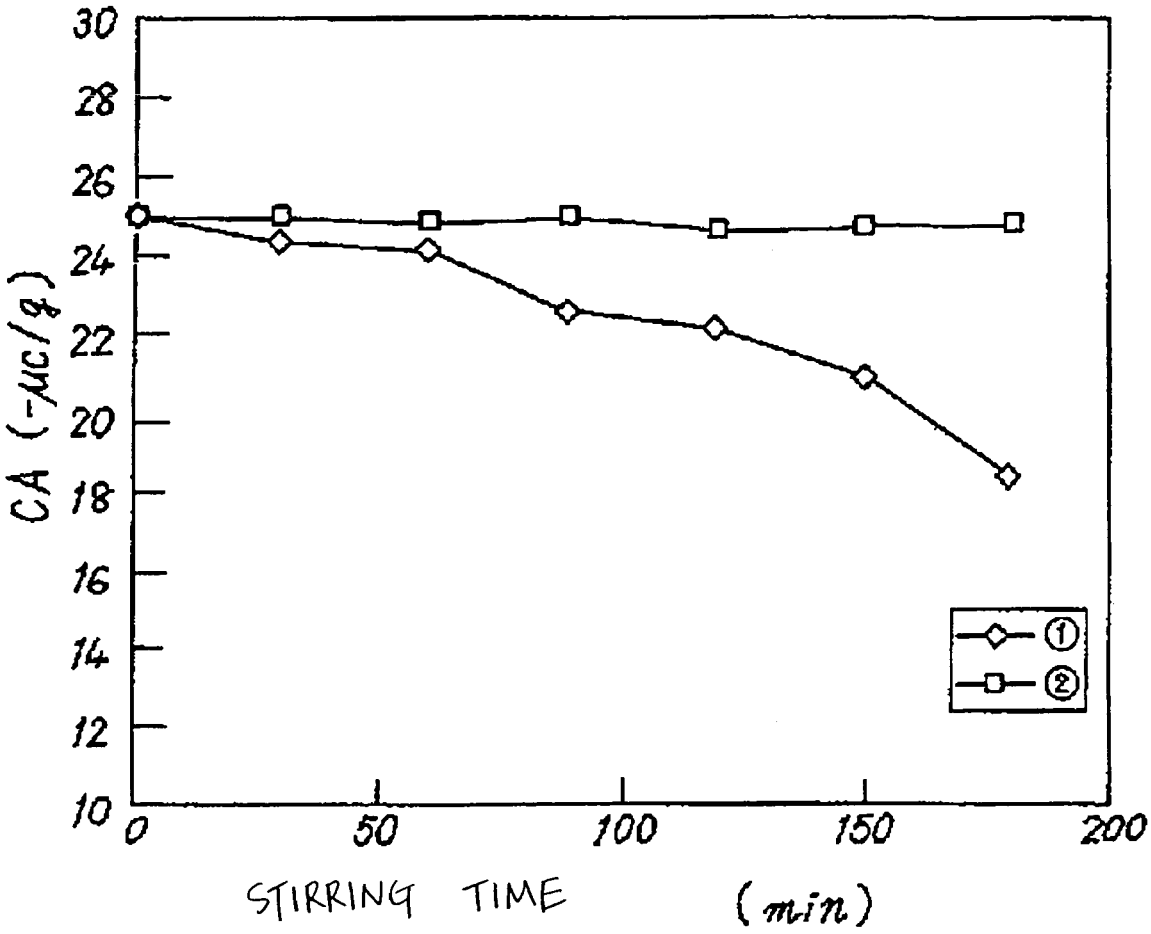
FIG. 4 is a graph for explaining influence of a doctor blade on developer deterioration.

From among the components of the developing device 4 mainly the developer applies stress on the doctor blade 44. FIG. 4 is a graph of a comparison of a case (1) that the doctor blade 44 is provided and another case (2) that the doctor blade 44 is not provided regarding change in charging ability of carrier when only the developing device 4 is taken out singly and stirring of the developer is continued within the developing device 4 for a long time by driving the developing device 4 externally. The charging ability of the carrier means a charged amount when only carrier is taken out from the developer and it is mixed with unused new toner in a predetermined amount and stirred for a predetermined time, and it is hereinafter called "CA". It is also desirable that the CA is not changed over time. It is considered that the life of the developer is shortened by reduction in ability of the carrier that charges toner due to lowering of CA. When the two cases (1) and (2) are compared regarding change of CA in FIG. 4, it is understood that the doctor blade 44 largely influences the life of the developer. This is because a film of wax is formed on the surface of the carrier and that decreased CA so that capacity to charge the toner deteriorated. Accordingly, in order to extend the life of the developing device 4, it is most effective to reduce stress on the developer from the doctor blade 44.

As the influence of the stress on the developer from the doctor blade 44, such a phenomenon that additives to the toner are buried in or released from toner can be indicated. This is because the developer is rubbed by the doctor blade 44 while it passes through the doctor blade 44 repeatedly so that the toner undergoes pressure in the developer. When images with a large image area are continuously output, since toner replacement frequently occurs, such a phenomenon does not become problematic particularly. Such a phenomenon easily occurs when images with a small image area are continuously output. In such a case, the additive is consumed from the toner surface and an adhering force between toner and carrier is strengthened, that results in lowering of a developing capability. When carrier is covered with toner that does not include additives, since it becomes difficult to replace used toner with newly supplemented toner, the supplemented toner is conveyed to the developing region as it remains uncharged, that may cause scumming or toner scattering. There occurs such a drawback that it becomes difficult to transfer toner adhered to the photosensitive body 1, that results in lowering of graininess of image or concentration shortage.

Figure 3:
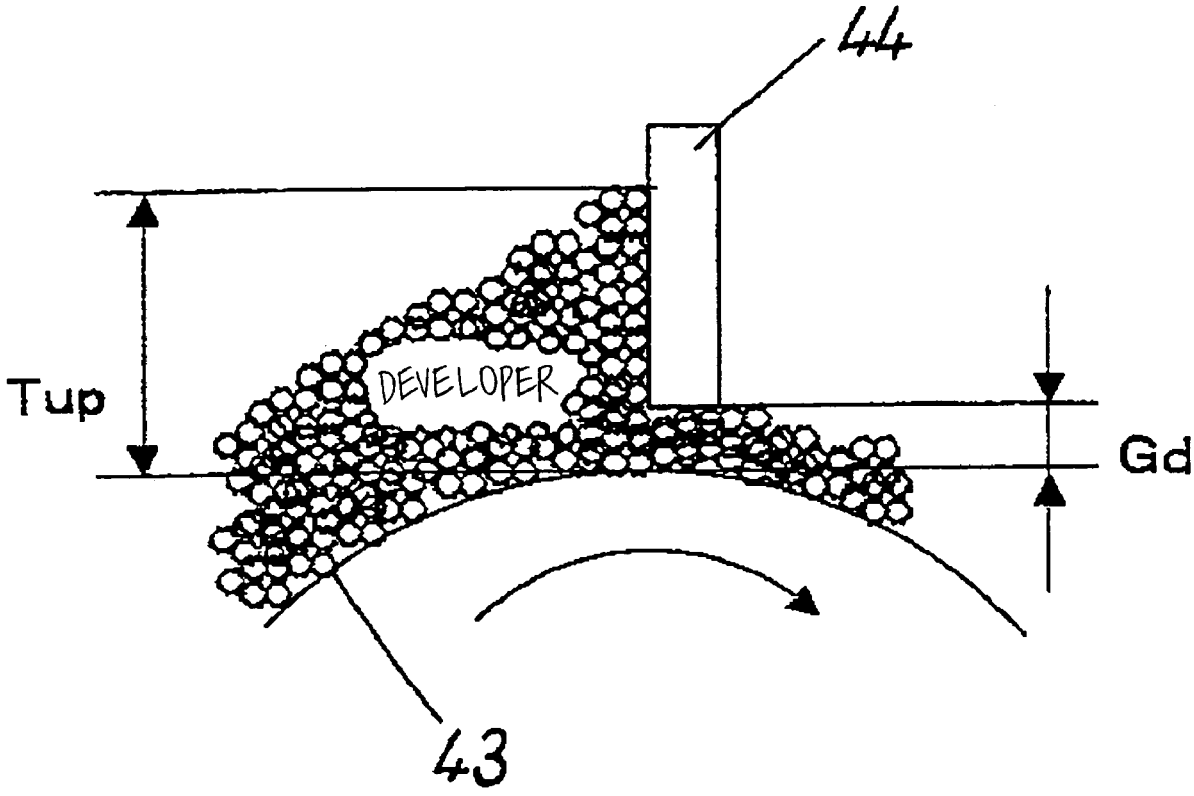
FIG. 3 is an enlarged side view for explaining functions of a developer restricting unit according to the embodiment.

It is found that the largest stress that the developer undergoes is a stress from the doctor blade 44, which causes various problems. As shown in FIG. 3, the stress from the doctor blade 44 includes a stress generated due to rubbing by the doctor blade 44 when the developer passes through the doctor blade 44, and a stress generated due to a compressed state of the developer held on the developing sleeve 43 before doctor blade 44.

In order to conduct developing with a high quality faithful to an electrostatic latent image, toner in the developer to be conveyed to the developing region should be charged sufficiently. Here, the toner in the developer is further charged by coming in contact with the carrier under the mechanical stress from the doctor blade 44, and it is conveyed to the developing region in sufficiently charged state. For this reason, when the mechanical stress on the developer passing through the doctor blade 44 is reduced, it is impossible to sufficiently charge toner in the developer to be conveyed to the developing region, which causes such a drawback as toner scattering or scumming.

Therefore, in order to reduce deterioration of the developer due to the stress over a long term, it is thought effective for stress reduction to reduce a compressed state of an excessive developer before the doctor blade 44, namely to reduce the amount of developer carried by the developing sleeve 43. The reduction in the amount of the developer can be achieved by reducing a magnetic force of the magnet roller 42 positioned upstream of the doctor blade 44 in the rotational direction of the photosensitive body 1. In order to reduce a rubbing force from the doctor blade 44, it is also effective to use magnetic material as the material for the doctor blade 44 partially or wholly. This is because, when the magnetic material is used for the doctor blade 44, magnetic flux generated from the magnetic poles inside the magnet roller 42 that is arranged near the doctor blade 44 is concentrated on the doctor blade 44 so that a doctor gap Gd between the developing sleeve 43 and the doctor blade 44 can be increased as compared with when the magnetic material is not used for the doctor blade 44.

sleeve 43 is 18 mm, and the linear velocity of the developing sleeve 43 is 408 mm/sec. The particle diameter of toner used was 5.5 μm, the circularity of the toner particle was 0.98, the volume average particle diameter/number average particle diameter was 1.15, the particle diameter of carrier was 35 μm, the total amount of developer in the developing device 4 was 280 grams. The position indicating the maximum magnetic flux density in the normal direction to the doctor magnetic pole opposed to the doctor blade 44 was set to about 0 degree.

In addition to the above basic constitution, table 1 shows evaluations of conditions 1 to 12 for 4 levels of the doctor gap Gd and 3 levels of the developer height before the doctor blade Tup for each of the doctor gap Gd levels.

TABLE 1

| | Gd (mm) | Tup (mm) | Tup/Gd | MAGNETIC PLATE | ADDITIVE STATE ON TONER SURFACE | SATURATED CHARGED AMOUNT ARRIVAL TIME (sec) | TONER SCATTERING | SCUMMING | REDUCTION IN CA (−μc/g) |
|---|---|---|---|---|---|---|---|---|---|
| CONDITION 1 | 0.5 | 3.3 | 6.6 | ABSENCE | ○ | 15 | X | X | 2.1 |
| CONDITION 2 | 0.5 | 9.5 | 19.0 | ABSENCE | Δ | 6 | Δ | ○ | 1.5 |
| CONDITION 3 | 0.5 | 15.3 | 30.6 | PRESENCE | X | 4 | X | X | 7.8 |
| CONDITION 4 | 0.6 | 3.8 | 6.3 | PRESENCE | ○ | 16 | X | X | 2.3 |
| CONDITION 5 | 0.6 | 10.0 | 16.7 | ABSENCE | Δ | 5 | Δ | ○ | 2.0 |
| CONDITION 6 | 0.6 | 14.3 | 23.8 | ABSENCE | X | 3 | X | X | 6.9 |
| CONDITION 7 | 0.7 | 5.2 | 7.4 | PRESENCE | ○ | 6 | ○ | ○ | 1.3 |
| CONDITION 8 | 0.7 | 13.0 | 18.6 | PRESENCE | ○ | 4 | ○ | ○ | 2.2 |
| CONDITION 9 | 0.7 | 17.2 | 24.6 | PRESENCE | X | 3 | X | X | 9.3 |
| CONDITION 10 | 0.8 | 6.0 | 7.5 | ABSENCE | ○ | 8 | Δ | Δ | 2.0 |
| CONDITION 11 | 0.8 | 15.1 | 18.9 | PRESENCE | ○ | 5 | ○ | ○ | 3.6 |
| CONDITION 12 | 0.8 | 18.3 | 22.9 | PRESENCE | X | 3 | X | X | 8.5 |

Figure 5:
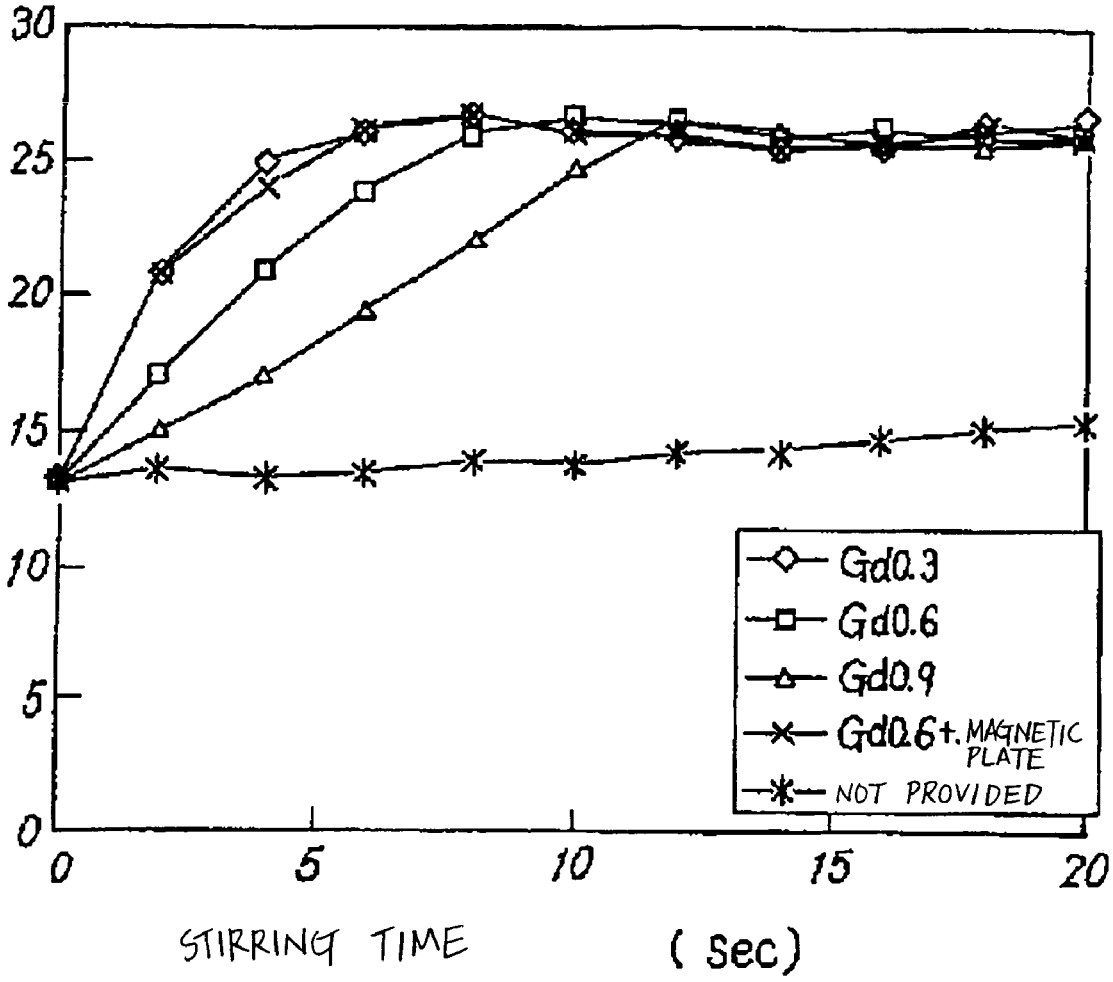
FIG. 5 is a graph for explaining influence of the doctor blade on charging performance.

The research result about influence of the doctor blade 44 on toner charging will be explained next with reference to FIG. 5. FIG. 5 depicts the measurement results about how the charged amount of toner supplemented into the developing device 4 increases according to increase in rotation time of the developing sleeve 43 in a configuration that a magnetic plate is added to the doctor blade 44, for three different doctor gaps Gd and when the doctor blade 44 is not provided. It is found from FIG. 5 that, when the doctor blade 44 is not provided, toner is hardly charged, while a rise of the charge amount of the toner becomes sharp as the doctor gap Gd becomes narrower. It is also seen that the rise performance of charging is improved in case of the doctor blade 44 added with the magnetic plate even if the doctor gap Gd is the same. In particular, it is important that the toner supplemented reaches a desired charged amount in the developing device 4 instantaneously. If a required charged amount can not be achieved, such a drawback as scumming or toner scattering occurs. In view of these circumstances, the shaper the charging rise of toner, the more preferable. However, since it is considered that stress on the developer generated when it passes through the doctor blade 44 becomes larger in proportion to reduction of the doctor gap Gd, it is important that these are compatible with each other.

In examples, evaluation was made in variously changed conditions in an experimental machine and judgment about the respective conditions was made. Experimental conditions are described below. Setting was made that the nearest distance between the developing sleeve 43 and the photosensitive body 1 is 0.3 mm, the diameter of the photosensitive body 1 is 30 mm, the linear velocity of the photosensitive body 1 is 240 mm/sec, the diameter of the developing The developer height before the doctor blade Tup can be freely changed by changing magnetic flux density of the doctor magnetic pole arranged opposed to the drawing magnetic pole that draws the developer on the developing sleeve 43 and the doctor blade 44. Evaluation items are as follows.

Additive State on Toner Surface:

Existing state of the additive obtained when surface observation of the toner is performed by scanning electron microscope (SEM) after the developing device was driven for 30 minutes without outputting an image and the developer was taken out:

○: State that toner surface is coated with additive without change from the initial state Δ: State that additive on toner surface has decreased as compared with the initial stage x: State that no additive is found on toner surface.

Saturated Charged Amount Arrival Time:

The charged amount of toner after passing through the doctor blade when the developing device is driven singly was measured every one second and respective time required to reach saturated charged amounts were compared with one another. The condition that the arrival time is shorter is better.

Toner Scattering and Scumming:

In the experimental machine, dirt in the machine and scumming on a background image were estimated with eyes as ○: good, Δ: possible, and X: failure, when 50,000 sheets of charts with an image area of 5% were continuously output.

CA Lowered Amount:

A charged amount when only carrier were taken out from developer used when 50,000 sheets of charts with an image area of 5% were continuously output in the experimental machine like the "toner scattering and scumming" above and the carrier was mixed with a predetermined amount of new toner to be stirred for a predetermined time, and an initial charged amount were compared with each other and estimated. The condition that the lowering is small is better.

From the results, the following was found. The results of conditions 1 to 3 that the doctor gaps Gd were the same and the heights of the developer before the doctor blade were different will be described below. In condition 1, since the developer height before the doctor blade was low and the developer passed through the doctor blade without undergoing excessive stress, the additive existing state on the toner surface was not changed from its initial state, and the CA lowering amount was reduced over time. However, since a ong time was taken until the charged amount of the toner was saturated and toner to be supplemented at any time was hard to be charged, deterioration regarding the toner scattering or the scumming was caused. In condition 2, since the developer height before the doctor blade was higher than that in condition 1, the time until the charged amount of toner was saturated became shorter than that in the condition 1. The additive existing state of toner was reduced as compared with its initial existing state, but it maintained a level that the toner could be used without any problem, and satisfactory results about the toner scattering, the scumming and the CA lowering were obtained over time. In condition 3, since the developer excessively existed before the doctor blade, the developer was easy to undergo stress, the additive did not exist on the toner surface, and CA was lowered largely, that resulted in occurrence of toner scattering and scumming over time. In conditions 1 to 3, it was found that, since the stress on the developer was reduced according to lowering of the developer height before the doctor blade, these conditions were advantageous for the additive adhering state on the toner surface and for maintaining CA over time. However, since the toner was hard to be charged, these conditions were disadvantageous for toner scattering or scumming, so that there was a tendency of increase in developer height before the doctor blade was reversed to the case that the developer height was low, that resulted in occurrence of toner scattering or scumming. The above tendency observed also in conditions 4 to 12, and conditions meeting all the evaluation items were conditions 2, 5, 7, 8, 10, and 11. In particular, in conditions 7, 8, and 11, excellent results were obtained regarding all the items by adding the magnetic plate to the doctor blade 44.

From these facts, attention was paid to the parameter Tup/Gd regarding the doctor gap Gd and the developer height before the doctor blade Tup, and a relationship between the parameter Tup/Gd, and the charging performance and the life of the developer was examined. As a result, when the doctor gap Gd was large and the developer height before the doctor blade Tup was low, specifically, when the parameter Tup/Gd was 7 or less, the developer did not undergo excessive stress and the life of the developer was extended. However, it was found that, since the time elapsed until the charged amount of toner was saturated was long and the toner to be conveyed to the developing region was hard to be charged, the toner scattering and the scumming deteriorated. On the other hand, when the doctor gap Gd was small and the developer height before the doctor blade Tup was high, specifically, when the parameter Tup/Gd was 20 or more, the time elapsed until the charged amount of toner was saturated was short, and the charging performance of the toner to be conveyed to the developing region was excellent. However, it was also found that the developer was stressed easily, the toner scattering and the scumming occurred over time, and the life of the developer was short. Therefore, when the doctor gap Gd was made small to some extent, the time elapsed until the charged amount of toner was saturated was made relatively short and the developer height before the doctor blade Tup was made relatively low, specifically, in the range of $7<Tup/Gp<20$, stress over time was reduced and the level that the developer could be used without any problem could be maintained, though deterioration of developer was caused as compared with the initial stage of the developer. That is, in the range of $7<Tup/Gd<20$, satisfactory results about both the toner scattering and the scumming in an initial state and in a time-elapsed state could be obtained.

Figure 6:
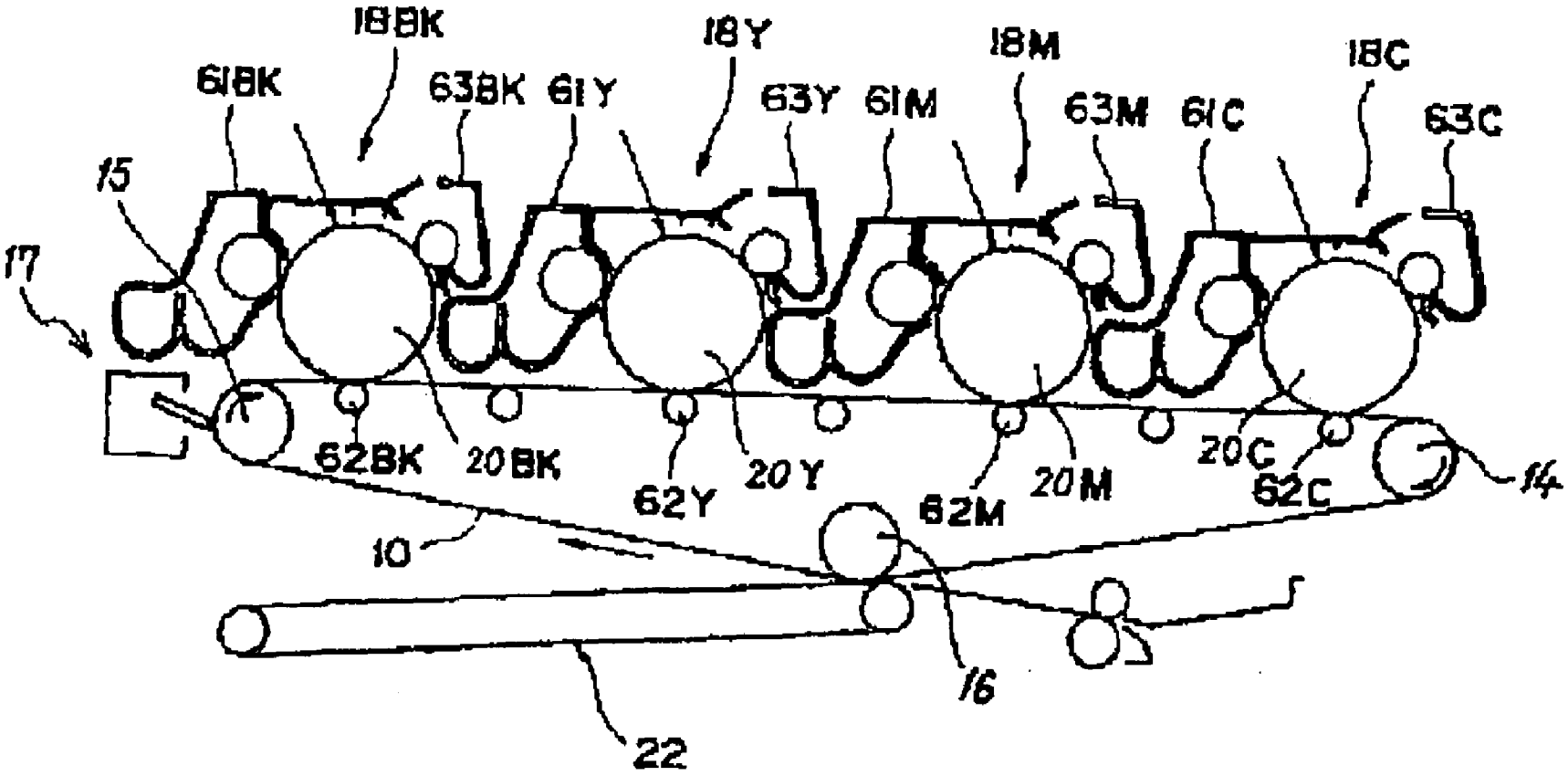
FIG. 6 is a side view of main sections of a color image forming apparatus according to the embodiment.

The developing device 4 according to the embodiment can be employed in a full color printer. FIG. 6 is a schematic configurational diagram of one example of an image forming unit of a full color printer. The printer is a tandem type color printer provided with four sets of process cartridge type toner image forming units 18Bk, 18Y, 18M, and 18C for forming respective images of black (Bk), yellow (Y), magenta (M), and cyan (C). Hereinafter, subscripts of respective symbols Bk, Y, M, and C represent black, yellow, magenta, and cyan, respectively. An intermediate transfer unit that moves an intermediate transfer belt 10 serving as an intermediate body in an endless manner while the belt is being spanned is arranged below the four sets of toner image forming units 18Bk, 18Y, 18M, and 18C. The four sets of toner image forming units 18Bk, 18Y, 18M, and 18C are arranged in this order from an upstream side in a moving direction of the intermediate transfer belt 10. The toner image forming units 18Bk, 18Y, 18M, and 18C are respectively provided with drum-like photosensitive bodies 20Bk, 20Y, 20M, and 20C serving as latent image carriers. An exposing device (not shown) is arranged above the toner image forming units 18Bk, 18Y, 18M, and 18C. The exposing device irradiates laser beams on surfaces of the respective photosensitive bodies 20Bk, 20Y, 20M, and 20C based on image data in a scanning manner. Electrostatic latent images corresponding to black, yellow, magenta, and cyan are formed on the photosensitive bodies 20Bk, 20Y, 20M, and 20C by beam irradiation. The toner image forming units 18Bk, 18Y, 18M, and 18C use toners of black, yellow, magenta, and cyan different in color from one another as developers, but they have the same constitution except for these colors. Therefore, the toner image forming unit 18Y for yellow toner will be explained below as a representative example.

The toner image forming unit 18Y is provided with a drum-like photosensitive body 20Y, a cleaning device 63Y, a charge removing device (not shown), a charging device, a developing device 61Y, and the like. The toner image forming unit 18Y is attachable to/detachable from a printer main body, and expendable parts or supplies may be replaced with new parts or supplies. The charging device uniformly charges a surface of the photosensitive body 20Y rotationally driven by a driving unit (not shown) in a clockwise direction in FIG. 6. The uniformly charged surface of the photosensitive body 20Y is irradiated with a laser beam L from the exposing device to be formed with an electrostatic latent image for a yellow image. The electrostatic latent image is developed by the developing device 61Y using yellow toner. The yellow toner image is primarily transferred to the intermediate transfer belt 10. The cleaning device 63Y removes the residual toner on the surface of the photosensitive body 20Y after the primary transferring step. The charge removing device removes the residual charges on the photosensitive body 20Y after cleaning. The surface of the photosensitive body 20Y is initialized by the charge removing process to be prepared for the next image formation. In the other toner image forming units 18Bk, 18M, and 18C, black, magenta, and cyan toner images are also formed on the photosensitive bodies 20Bk, 20M, and 20C.

The intermediate transfer unit is provided with four primary transfer bias rollers 62Bk, 62Y, 62M, and 62C, an intermediate transfer belt cleaning device 17, and the like in addition to the intermediate transfer belt 10. The intermediate transfer unit is also provided with a secondary transfer backup roller 16, a cleaning backup roller 15, a tension roller 14, and the like. The intermediate transfer belt 10 is moved in an endless manner in a direction of arrow in FIG. 6 according to rotational drive of at least one of the three rollers while it is being wound thereabout. The primary transfer bias rollers 62Bk, 62Y, 62M, and 62C sandwich the endlessly moving intermediate transfer belt 10 between them and the photosensitive bodies 20Bk, 20Y, 20M, and 20C to form primary transfer nips. These primary transfer bias rollers 62Bk, 62Y, 62M, and 62C are constituted so as to apply transfer biases with polarity (for example, plus polarity) opposed to that of toner on a back face (a loop inner peripheral face) of the intermediate transfer belt 10. All rollers except for the primary transfer bias rollers 62Bk, 62Y, 62M, and 62C are electrically grounded. The intermediate transfer belt 10 is transferred with black, yellow, magenta, and cyan images positioned on the photosensitive bodies 20Bk, 20Y, 20M, and 20C in a superimposed manner in a course of sequential passage of the primary transfer nips for black, yellow, magenta, and cyan according to endless movement thereof. Thereby, a toner image of four superimposed colors (herein, a four-color toner image) is formed on the intermediate transfer belt 10.

A secondary transfer device 22 is provided below the intermediate transfer belt 10 on a downstream side of the toner image forming unit 18C so as to be opposed to the secondary transfer backup roller 16. Here, the secondary transfer backup roller 16 sandwiches the intermediate transfer belt 10 between itself and the secondary transfer device 22 to form a secondary transfer nip. A fixing unit and a sheet discharging roller pair (not shown) are provided downstream of the secondary transfer nip.

A transfer medium is fed toward the secondary transfer nip at a proper timing. The four-color toner image formed on the intermediate transfer belt 10 is transferred on the transfer medium at the secondary transfer nip. The remaining toner that has not been transferred on the transfer medium adheres to the intermediate transfer belt 10 after passing through the secondary transfer nip. This remaining toner is cleaned by the cleaning device 17. The transfer medium fed out from the secondary transfer nip is fused with the four-color toner image transferred on the surface thereof under heat and pressure while the transfer medium passes between the rollers of the fusing device. Thereafter, the transfer medium passes between the rollers of a discharging roller pair to be discharged externally.

In such a color printer, a relationship between the developer layer thickness just before the developer passes through the doctor blade Tup and the doctor gap Gd in each of the developing device 61Bk, 61Y, 61M, and 61C meets $7<Tup/Gd<20$. Thereby, the mechanical stress can be reduced to extend life of the developer and sufficiently charged developer can be conveyed to the developing region so that a full color image with a high quality can be obtained.

In the above embodiments, by satisfying the relation of $7<Tup/Gd<20$ between the developer layer thickness just before the developer passes through the doctor blade Tup and the doctor gap Gd, the mechanical stress can be reduced to extend life of the developer, and sufficiently charged developer can be conveyed to the developing region.

Such a doctor magnetic pole that magnetic flux density in a normal direction becomes the maximum is provided at a position of the magnet roller 42 of the developing sleeve 43 serving as the magnetic field generating unit, that is opposed to the doctor blade 44. Thereby, the rise performance of toner charging can be improved.

By using magnetic material in the doctor blade 44 partially or wholly, the rise performance of toner charging can be enhanced.

As the toner, toner obtained by dissolving or dispersing, in organic solvent, at least modified polyester resin that can achieve urea coupling and toner composition including wax serving as a releasing agent to disperse the dissolved or dispersed material in aqueous solvent, causing polyaddition reaction, and performing removal of the solvent from the dispersed solution and washing, is used. Thereby, a manufacturing cost can be suppressed and spherical toner particles falling in a small range of particle distribution can be used, so that an image with an excellent graininess can be obtained. The fluidity of toner is excellent, dispersing property in developer is excellent, and charging rise of toner is superior.

Toner with a volume average particle diameter in the range of 4 to 8 μm is used. By using toner with a small particle diameter in this manner, an image with a high resolution and an excellent graininess can be obtained.

The value of the volume average particle diameter/number average particle diameter of the toner is set to 1.20 or less. Thereby, it is made possible to conduct uniform development with toner having a narrow toner particle distribution and uniform particle diameter.

The circularity of toner particles is set to the range of 0.95 or more to less than 1.00. Such spherical toner can be used so that an image with an excellent graininess can be obtained.

Carrier with a weight average particle diameter in the range of 20 μm to 60 μm is used. By using carrier with such a small particle diameter, stable charging can be provided to toner and simultaneously a fine magnetic brush can be formed, so that an image with an excellent graininess can be obtained.

In a color image forming apparatus provided with an image carrier carrying electrostatic latent images and a plurality of developing devices that develop the electrostatic latent images, this developing device is used. By using a developing device having both an excellent stress reduction to developer and an excellent charging rise property of toner, full color images with high image quality that do not include an abnormal image with scumming or toner scattering can be obtained for a long period.

A process cartridge that supports at least the photosensitive body and the developing device in an integral manner and is attachable to/detachable from an image forming apparatus main body is provided. Thereby, a process cartridge that does not cause scumming or toner scattering, and can form a stable image with a high resolution and an excellent graininess can be provided.

Figure 8:
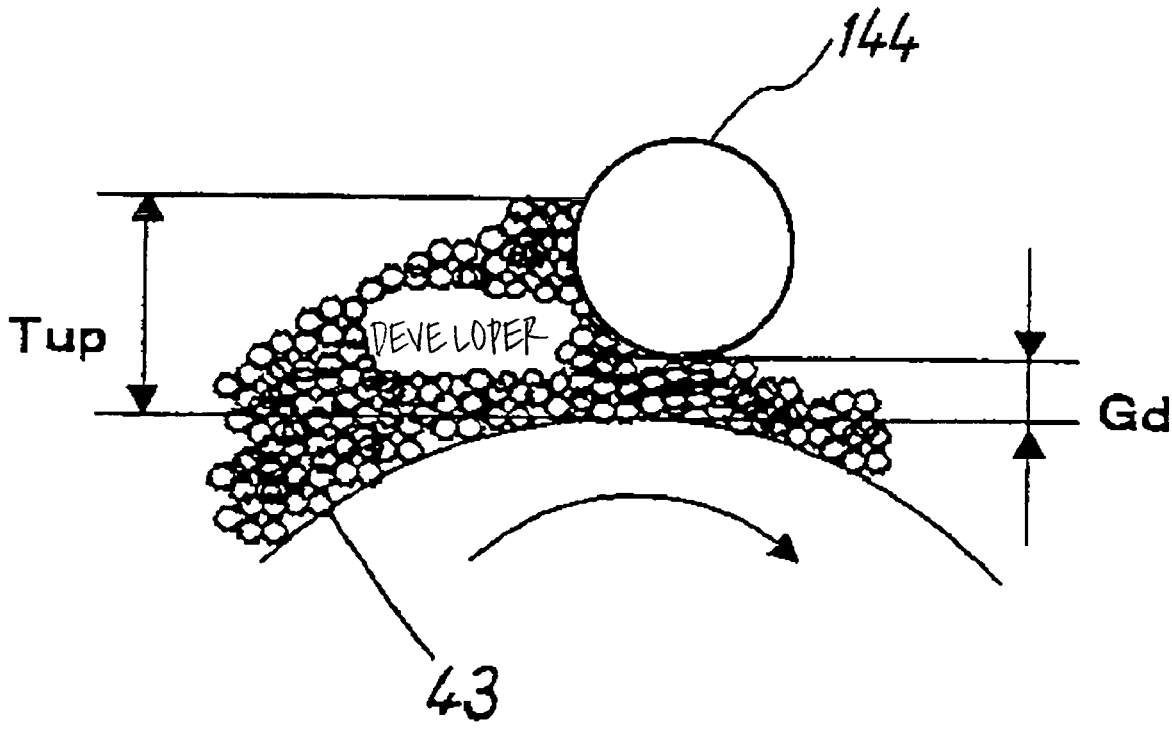
FIG. 8 is a side view of a doctor roller according to another embodiment of the present invention.

The developer restricting member in the embodiment explained above is the doctor blade 44, however, the developer restricting member may have other forms. For example, similar effects can be achieved when the developer restricting member is a doctor roller 144 as shown in FIG. 8.

In an embodiment of the present invention, conditions where sufficiently charged developer is conveyed to the developing region while reducing mechanical stress due to the developer restricting member, are obtained based on the following consideration and experiments.

As regards to influence that the developer restricting member imparts on the charging of toner, as the gap between the developer restricting member and the sleeve (hereinafter, "doctor gap Gd") becomes narrower, charging rise of toner in the developer becomes sharper at the developer restricting member, so that sufficiently charged toner can be conveyed to the developing region.

On the other hand, as shown in FIG. 3, as the stress imparted from the developer restricting member, there are a stress generated due to that, when the developer passes through the developer restricting member, it is rubbed by the developer restricting member in a sliding manner, and another stress generated due to that the developer held on the developer carrier becomes compressed before the developer restricting member. The stress generated due to that, when the developer passes through the developer restricting member, it is rubbed by the restricting member in a sliding manner, can be reduced by expanding the doctor gap Gd, but the gap can not be expanded excessively in view of the charging performance of the toner conveyed to the developing region, as described above. Therefore, in order to reduce the stress generated from the developer restricting member for a long period, it is considered to be effective to reduce the compressed state of the excessive developer before the developer restricting member, namely, to lower a developer height Tup just before the developer passes through the developer restricting member. The developer height Tup can be lowered by reducing the amount of the developer carried on the sleeve at an upstream side of the developer restricting member. Specifically, the lowering of the developer height Tup can be achieved by reducing magnetic flux density of a drawing magnetic pole that draws the developer on the sleeve, and a doctor magnetic pole provided to be opposed to the developer restricting member.

From these considerations, attention is paid to a parameter Tup/Gd regarding the doctor gap Gd and the developer height Tup just before the developer passes through the developer restricting member, and a relationship among the parameter Tup/Gd, a charging performance of the toner, and the life of the developer is studied by changing the doctor gap Gd and the developer height Tup, as shown with the experiment described below. As a result of experiment, it is found that, when the doctor gap Gd is large and the developer height Tup just before the developer passes through the developer restricting member is low, specifically, when Tup/Gd is 7 or less, the life of the developer is elongated, since the developer does not undergo excessive stress. However, it has been found that, since the time elapsed until the charged amount of the toner is saturated becomes long and the toner to be conveyed to the developing region becomes difficult to be charged, the developer becomes poor regarding the toner scattering or the scumming. On the other hand, it is also found that, when the doctor gap Gd is small and the developer height Tup just before the developer passes through the developer restricting member is high, specifically, when the parameter Tup/Gd is 20 or more, the time elapsed until the charged amount of the toner is saturated becomes short and the charging performance of the toner to be conveyed to the developing region is excellent. However, it is further found that, since the developer is easily subjected to stress and toner scattering and scumming occur over time, the life of the developer becomes short. In view of these circumstances, it is found that, when the time elapsed until the charged amount of the toner is saturated is reduced by the making the doctor gap Gd small to some extent and the developer height Tup just before the developer passes through the developer restricting member is set relatively small, specifically in the range of 7<Tup/Gd<20, stress is reduced over time and the developer can be used without any problem, though it is deteriorated as compared with its initial state. That is, in the range of 7<Tup/Gd<20, satisfactory results are achieved regarding both the toner scattering and the scumming in an initial stage and in a time-elapsed stage. Thus, the relationship of 7<Tup/Gd<20 between the developer layer thickness just before the developer passes through the developer restricting member and the doctor gap Gd, it is possible to reduce the mechanical stress to achieve a long life of the developer and convey the sufficiently charged developer to the developing region.

According to the present invention it is possible to prolong the life of developer by applying less mechanical stress. Moreover, there is no increase in the parts. Furthermore, because the developer can be appropriately charged, it can be conveyed to a developing region, and toner scattering or scumming is not caused.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A developing device comprising:

a developer accommodating member that accommodates two-component developer containing toner and magnetic carrier;

a developer carrier that includes a rotatable non-magnetic sleeve that includes a plurality of fixed magnetic field generating units therein and causes the magnetic field generating units to carry two-component developer inside the developer accommodating unit on a surface thereof to convey the same to a developing region opposed to an image carrier; and a developer restricting member that restricts a layer thickness of developer on the developer carrier, wherein a thickness Tup of a layer of the developer just before the layer passes through the developer restricting member and a gap Gd between the developer restricting member and the developer carrier satisfy an inequality 7<Tup/Gd<20.

2. The developing device according to claim 1, wherein each of the magnetic field generating units in the developer carrier has such a restricting unit magnetic pole that magnetic flux density in a normal direction becomes maximum at a position opposed to the developer restricting member.

3. The developing device according to claim 1, wherein the developer restricting member is partially or wholly made of magnetic material.

4. The developing device according to claim 1, wherein the toner is obtained by dissolving or dispersing, in organic solvent, at least modified polyester resin that can achieve urea coupling and toner composition including wax serving as a releasing agent, to disperse the dissolved or dispersed material in aqueous solvent, causing polyaddition reaction, and performing removal of the solvent from the dispersed solution and washing.

5. The developing device according to claim 1, wherein a volume average particle diameter of the toner is in the range of 4 micrometers to 8 micrometers.

6. The developing device according to claim 1, wherein a value of a volume average particle diameter/number average particle diameter of the toner is 1.20 or less.

7. The developing device according to claim 1, wherein a circularity of toner particles is in the range of 0.95 or more to less than 1.00.

8. The developing device according to claim 1, wherein a weight average particle diameter of the carrier is in the range of 20 micrometers to 60 micrometers.

9. An image forming apparatus comprising an image carrier that carries an electrostatic latent image and a developing device, wherein the developing device includes;

a developer accommodating unit that accommodates two-component developer containing toner and magnetic carrier;

a developer carrier that includes a rotatable non-magnetic sleeve that includes a plurality of fixed magnetic field generating units therein and causes the magnetic field generating units to carry two-component developer inside the developer accommodating unit on a surface thereof to convey the same to a developing region opposed to the image carrier; and a developer restricting member that restricts a layer thickness of developer on the developer carrier, wherein a thickness Tup of a layer of the developer just before the layer passes through the developer restricting member and a gap Gd between the developer restricting member and the developer carrier satisfy an inequality $7<Tup/Gd<20$.

10. A process cartridge that supports an image carrier that carries a latent image and a developing device that supplies toner to the latent image on the image carrier in an integral manner to develop the latent image, and is attachable to/detachable from an image forming apparatus main body, wherein the developing device includes a developer accommodating unit that accommodates two-component developer containing toner and magnetic carrier;

a developer carrier that includes a rotatable non-magnetic sleeve that includes a plurality of fixed magnetic field generating units therein and causes the magnetic field generating units to carry two-component developer inside the developer accommodating unit on a surface thereof to convey the same to a developing region opposed to the image carrier; and a developer restricting member that restricts a layer thickness of developer on the developer carrier, wherein a thickness Tup of a layer of the developer just before the layer passes through the developer restricting member and a gap Gd between the developer restricting member and the developer carrier satisfy an inequality $7<Tup/Gd<20$.

11. A developing method of developing an image using a developing device that includes a developer accommodating unit that accommodates two-component developer containing toner and magnetic carrier;

a developer carrier that includes a rotatable non-magnetic sleeve that includes a plurality of fixed magnetic field generating units therein and causes the magnetic field generating units to carry two-component developer inside the developer accommodating unit on a surface thereof to convey the same to a developing region opposed to an image carrier; and a developer restricting member that restricts a layer thickness of developer on the developer carrier, comprising:

conducting developing under a condition that a thickness Tup of a layer of the developer just before the layer passes through the developer restricting member and a gap Gd between the developer restricting member and the developer carrier satisfy an inequality $7<Tup/Gd<20$.

12. The developing method according to claim 11, wherein the conducting the developing is performed by using, as each of the magnetic field generating units in the developer carrier, a magnetic field generating unit that has such a restricting unit magnetic pole that magnetic flux density in a normal direction becomes maximum at a position opposed to the developer restricting member.

13. The developing method according to claim 11, wherein the conducting the developing is performed by using the developer restricting member that is partially or wholly made of magnetic material.

14. The developing method according to claim 11, wherein the conducting the developing is performed by using the toner that is obtained by dissolving or dispersing, in organic solvent, at least modified polyester resin that can achieve urea coupling and toner composition including wax serving as a releasing agent, to disperse the dissolved or dispersed material in aqueous solvent, causing polyaddition reaction, and performing removal of the solvent from the dispersed solution and washing.

15. The developing method according to claim 11, wherein the conducting the developing is performed by using a toner having a volume average particle diameter in the range of 4 micrometers to 8 micrometers.

16. The developing method according to claim 11, wherein the conducting the developing is performed by using a toner having a value of a volume average particle diameter/number average particle diameter of 1.20 or less.

17. The developing method according to claim 11, wherein the conducting the developing is performed by using a toner having a circularity of toner particles in the range of 0.95 or more to less than 1.00.

18. The developing method according to claim 11, wherein the conducting the developing is performed by using a carrier having a weight average particle diameter in the range of 20 micrometers to 60 micrometers.

* * * * *